US012607394B2

(12) United States Patent
Franklin, Jr. et al.

(10) Patent No.: US 12,607,394 B2
(45) Date of Patent: Apr. 21, 2026

(54) PORTABLE AIR-COOLING DEVICE

(71) Applicant: BendPak, Inc., Santa Paula, CA (US)

(72) Inventors: Larry L. Franklin, Jr., Camarillo, CA (US); Jeffrey S. Kritzer, Moorpark, CA (US)

(73) Assignee: BendPak, Inc., Agoura Hills, CA (US)

( * ) Notice: Subject to any disclaimer, the term of this patent is extended or adjusted under 35 U.S.C. 154(b) by 127 days.

(21) Appl. No.: 18/479,544

(22) Filed: Oct. 2, 2023

(65) Prior Publication Data

US 2024/0142155 A1 May 2, 2024

Related U.S. Application Data

(60) Provisional application No. 63/512,597, filed on Jul. 7, 2023, provisional application No. 63/381,273, filed on Oct. 27, 2022.

(51) Int. Cl.
*F25D 3/08* (2006.01)

(52) U.S. Cl.
CPC ..... *F25D 3/08* (2013.01)

(58) Field of Classification Search
CPC ..... F24F 5/0017; F25D 3/08
See application file for complete search history.

(56) References Cited

U.S. PATENT DOCUMENTS

| | | | | |
|---|---|---|---|---|
| 6,170,282 | B1 | 1/2001 | Eddins | |
| 2006/0225453 | A1* | 10/2006 | Martello | B60H 1/005 62/425 |
| 2011/0030413 | A1* | 2/2011 | Heil | F24F 5/0017 62/407 |
| 2011/0180069 | A1 | 7/2011 | McCabe | |
| 2013/0233002 | A1 | 9/2013 | Donaldson et al. | |
| 2018/0073769 | A1* | 3/2018 | Herweck | F24F 5/0017 |
| 2021/0325093 | A1 | 10/2021 | Rosales | |
| 2023/0112280 | A1* | 4/2023 | Banal | B62B 5/067 62/457.7 |

FOREIGN PATENT DOCUMENTS

CN 212299290 U * 1/2021

* cited by examiner

*Primary Examiner* — Ana M Vazquez
(74) *Attorney, Agent, or Firm* — AVEK IP, LLC; Kent R. Erickson

(57) ABSTRACT

A portable air-cooling device includes an insulated base for holding a coolant and a lid formed to cover the insulated base. The lid includes a heat exchange assembly for cooling an airflow and one or more openings for exhausting the airflow that has been cooled in the heat exchange assembly. Flexible, rotatable ducts are joined to each of the one or more openings of the lid and are positionable by a user to direct the airflow that has been cooled.

17 Claims, 15 Drawing Sheets

PORTABLE AIR-COOLING DEVICE

CROSS-REFERENCE TO RELATED APPLICATIONS

This application claims the benefit of U.S. Provisional Patent Application No. 63/381,273, filed Oct. 27, 2022 and U.S. Provisional Patent Application No. 63/512,597, filed Jul. 7, 2023, the disclosures of which are hereby incorporated herein in their entirety by reference.

BACKGROUND OF THE INVENTION

Field of the Invention

This invention relates to air-cooling devices in general and, more specifically, to portable air-cooling devices for cooling air by exposure to a heat exchanger.

Background

U.S. Pat. No. 9,091,449 of Donaldson et al. discloses a battery-powered, portable ice chest cooler with a lid in which an airway path is defined through a radiator in the lid for chilling air, a fan moves the air through the airway and out of the lid, and a pump moves water from the chest, through the radiator and back to the chest. Further, alternative air shafts for directing the airflow to the environment are disclosed. U.S. Pat. No. 8,776,789 of McCabe discloses a battery-powered portable athletic air cooler having a repository that holds ice, a fan to blow air through the ice, and two exit ducts with face adapters to provide cool air to users. U.S. Patent Application Publication No. 2021/0325093 discloses a portable air cooler with baffles that force intake air to pass through chilled articles and two vents having electrically-powered fans that exhaust cooled air from the air cooler.

A portable air cooling device is needed that includes a convenient, efficient, and portable form of electrical power to provide power to the components or to batteries powering the components of the air cooling device.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

A portable air-cooling device comprises an insulated container for holding a coolant, such as ice and water, and a lid or cover for the insulated container that includes a heat exchanger flow connected to a pump, one or more fans for directing an airflow through the device and across the heat exchanger, and one or more flexible nozzles for directing a cooled airflow as the cooled airflow exits the device. In a preferred embodiment, the portable air-cooling device includes a rechargeable power supply and a control panel for controlling the device, including the pump and the fans, independently.

The lid of the portable air-cooling device includes a top shell with an air intake grate for the intake of ambient air. The ambient air is directed to an airflow passageway directing the ambient air to the interior of the air-cooling device and through the heat exchanger. The top shell includes one or more centrally positioned openings extending through the top shell for exhausting the cooled airflow. The openings are joined to the user positionable flexible nozzles and are rotatably mounted on the lid to direct the cooled airflow exiting the air-cooling device.

The power supply of the portable air-cooling device is coupled to the control panel, the fans and the pump. In one preferred embodiment, the power supply is a rechargeable battery connected to at least one solar panel. The control panel is able to control each fan and the pump, independently. In one embodiment, the portable air-cooling device is couplable to a wireless controller, such as a remote control, a smartphone, a smart device, or another electronic device, for controlling the portable air-cooling device.

The top shell and a bottom shell of the lid enclose components for cooling the ambient air entering the air-cooling device. The components include the heat exchanger and the one or more fans. The pump may also be enclosed in the lid. In one embodiment the pump may be a submersible pump contained in the insulated container. The pump moves the coolant, typically water, from the insulated container to the heat exchanger and through the heat exchanger. After circulating through the heat exchanger, the coolant is then returned to the insulated container. Specifically, the heat exchanger includes an inlet port, an outlet port, one or more circuitous heat exchange conduits extending between the inlet and outlet ports and a plurality of heat exchange fins projecting from the heat exchange conduits. The coolant flows from the inlet port of the heat exchanger, though the heat exchange conduits, and then through the outlet port to a coolant return line which opens into the insulated container. The heat exchange fins absorb heat from the airflow as the airflow is drawn across and past the heat exchange conduits.

The fans draw the ambient air through an airflow passageway which flows through the portable air-cooling device. In one embodiment, the airflow of the ambient air is first cooled in the main compartment of the air-cooling device by direct cooling as the airflow moves past and contacts the coolant. The airflow is then drawn through the heat exchanger where it is further cooled via indirect cooling as the fins of the heat exchanger absorb heat from the airflow. In one embodiment, a plenum directs an ambient airflow through a channel and to the heat exchanger to be cooled, without direct cooling. The cooled airflow is pushed or expelled from the air-cooling device, through the fans and into the flexible nozzles to the exterior of the air-cooling device.

BRIEF DESCRIPTION OF THE DRAWINGS

Embodiments of the invention are described in detail below with reference to the attached drawing figures, wherein:

FIG. 12A shows openings through which the airflow is directed through the lid. FIG. 12B shows an openable plenum enclosure in a closed position. FIG. 12C shows the openable plenum enclosure in an open position.

Figure 1:
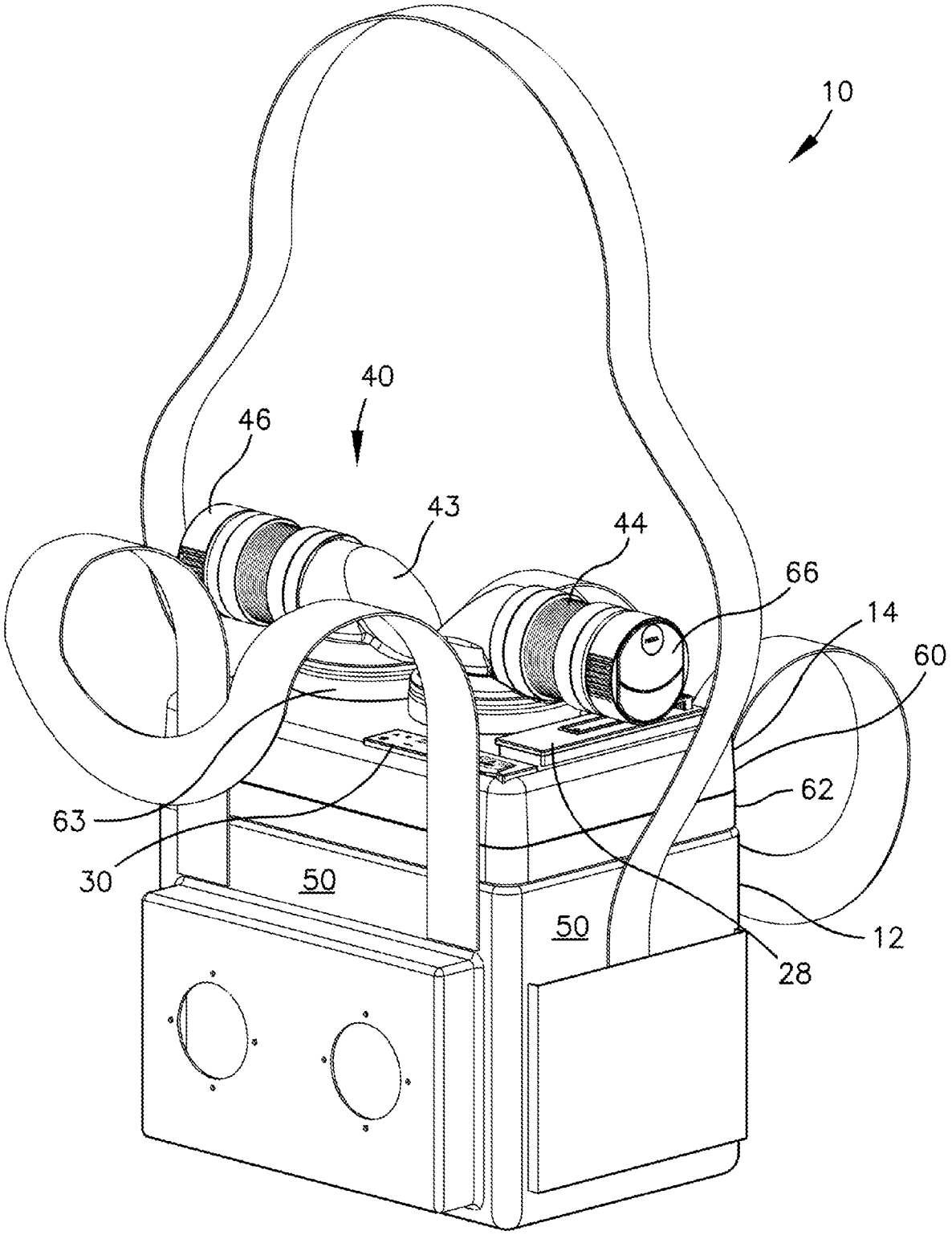
FIG. 1 is a front perspective view of an embodiment of a portable air-cooling device, the portable air-cooling device including an insulated container having carrying straps, an electronic speaker in a closed compartment on a side of an insulated container, and a lid having two flexible nozzles rotatably coupled thereto.

The drawing figures do not limit the invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Figure 2:
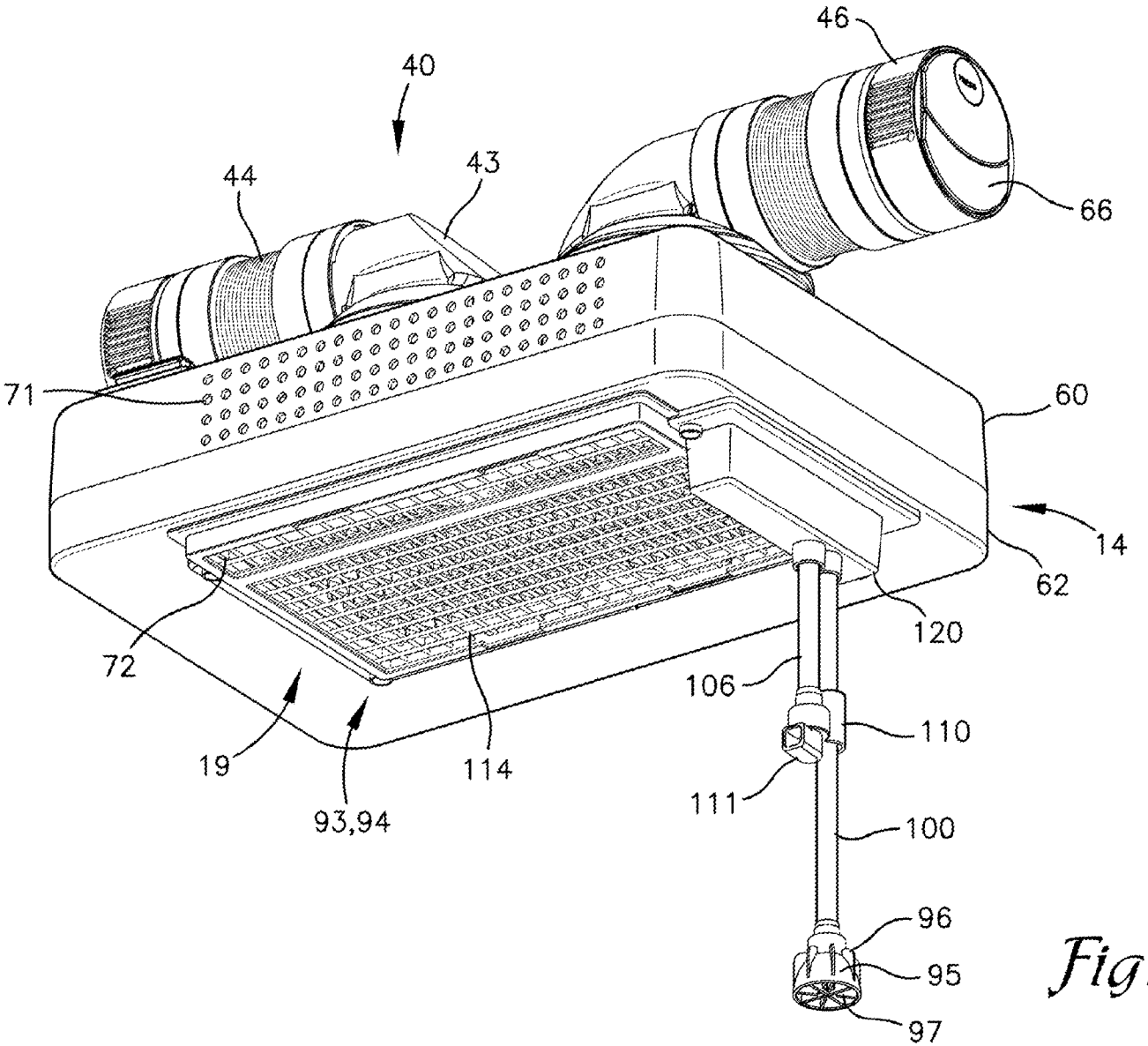
FIG. 2 is a perspective view from below the lid of the portable air-cooling device shown in FIG. 1, including an air inflow grate on a side of the lid for intake of a stream of air or airflow, a lower shell grate in covering relationship with a heat exchanger through which the stream of air is drawn for cooling, and the flexible nozzles through which a cooled air stream is expelled.
Figure 3:
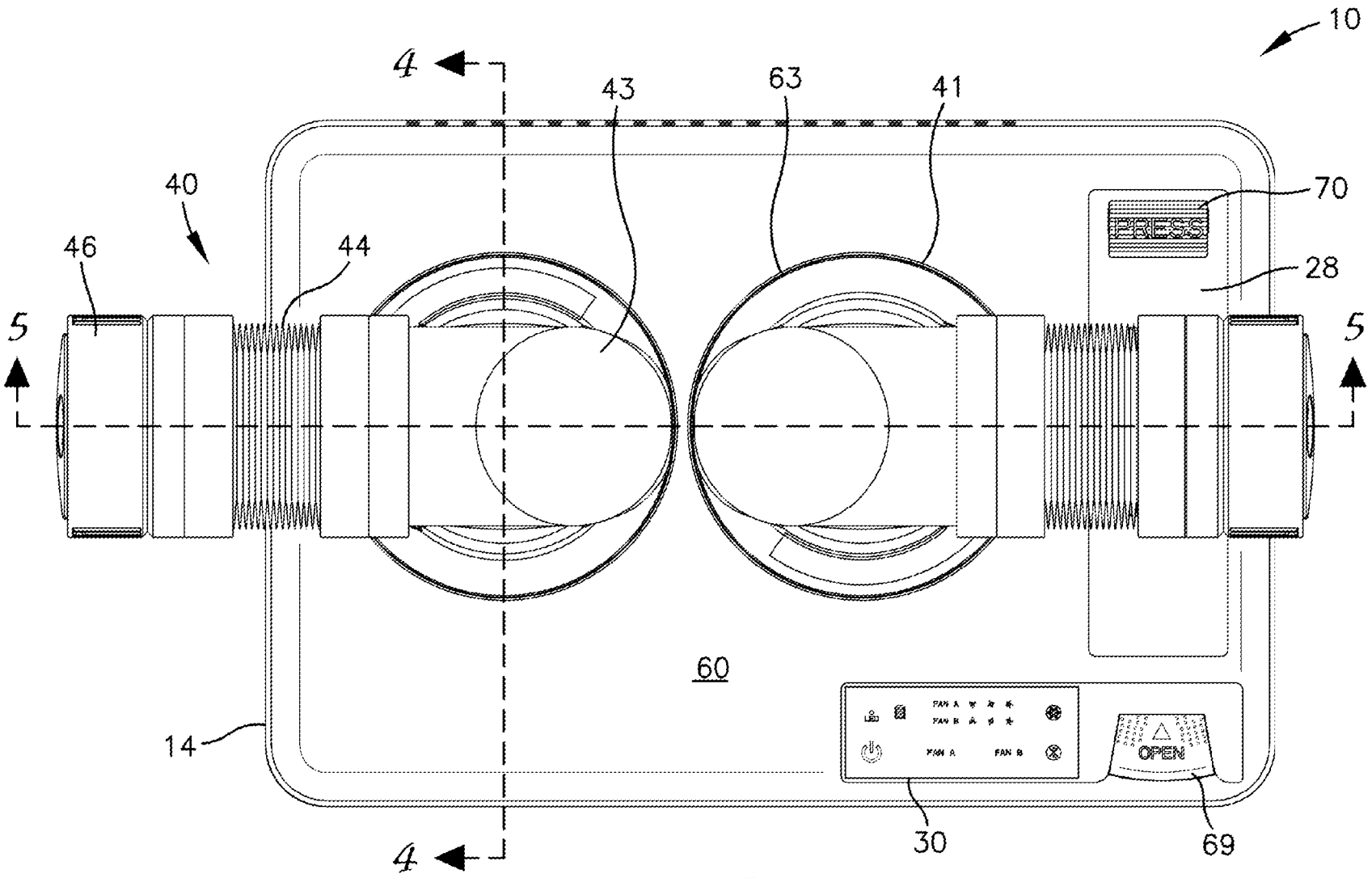
FIG. 3 is a view from above a top of the lid of the portable air-cooling device shown in FIG. 1, including the flexible nozzles, a removeable battery, a control panel, and a power port.
Figure 4:
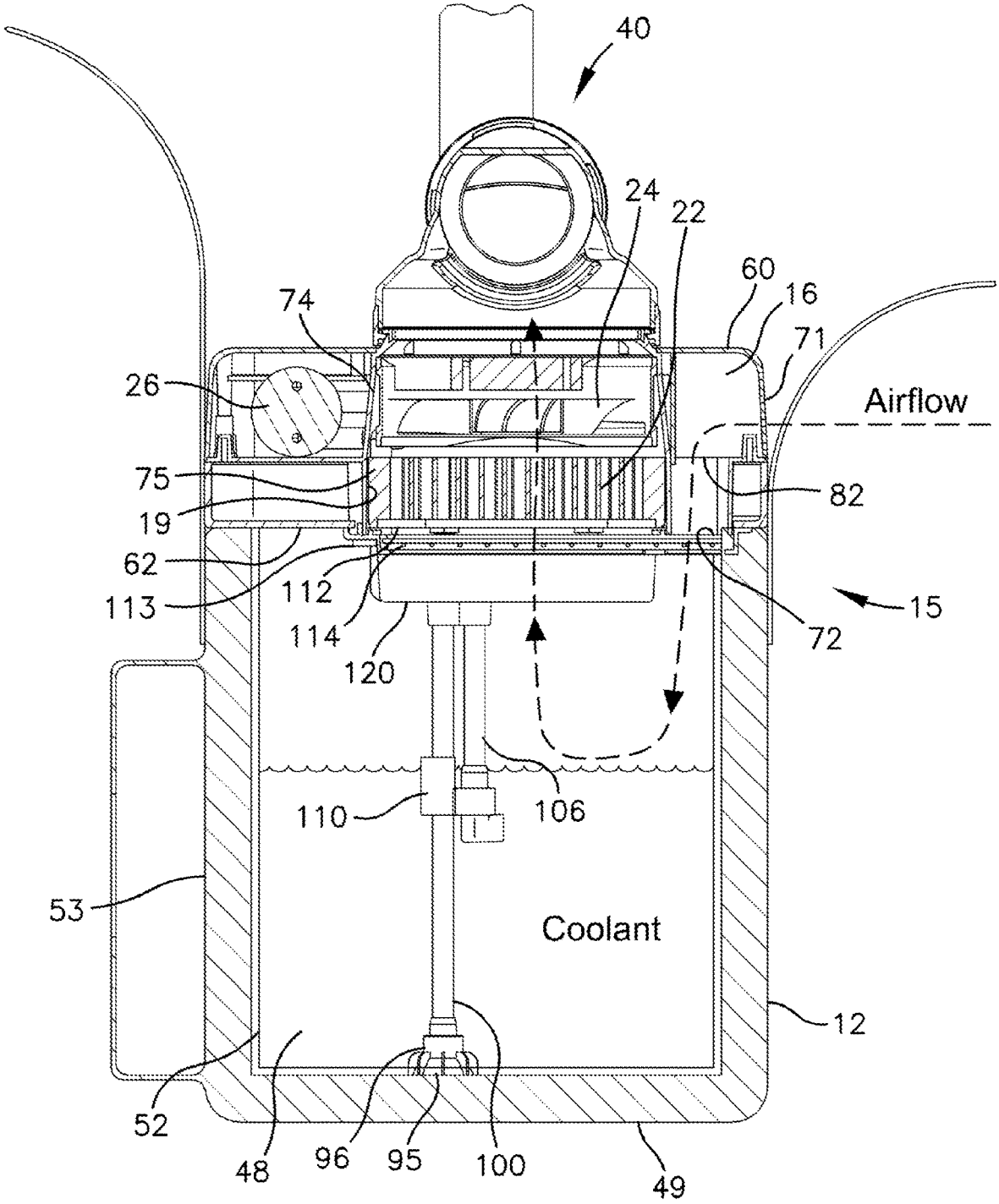
FIG. 4 is a cross-sectional view of the portable air-cooling device along line 4-4 in FIG. 3, showing an airflow passageway that extends through an air inflow grate in the lid, past a coolant in the insulated container, and through the heat exchange assembly.
Figure 5:
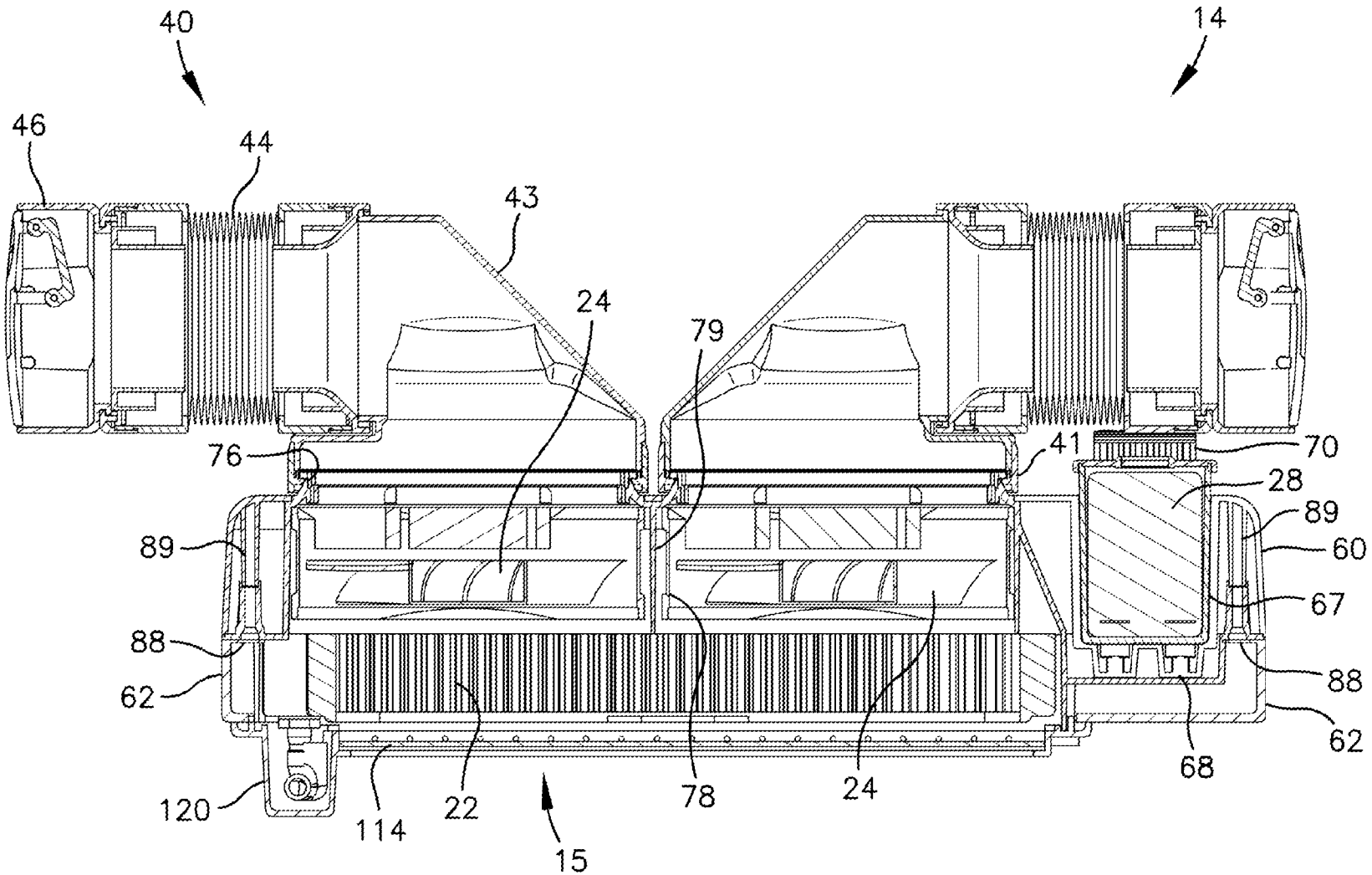
FIG. 5 is a cross-sectional view of the lid of the portable air-cooling device along line 5-5 in FIG. 3, showing the heat exchanger, two fans, and the flexible nozzles through which the cooled airflow exits the device.

Referring to FIGS. 1 and 2, reference number 10 generally designates a portable air-cooling device and reference number 14 generally designates a lid having a heat exchange assembly 15 mounted in or to the lid 14. The air-cooling device 10 includes an insulated base or insulated container 12 for containing a coolant or heat transfer fluid and the lid 14 having the heat exchange assembly 15 operable to draw a stream of ambient air into the insulated container 12, through one or more air intake ducts or air intake passageways 16 formed in the lid 14, and across the coolant to cool the ambient air through direct heat transfer between the coolant and the ambient air. The cooled stream of air is then directed through the heat exchange assembly 15 mounted in or to the lid 14 and across an opening to one or more air discharge passageways 19 in the lid 14 to further cool the stream of air. The cooled stream of air is then exhausted or directed out of the air-cooling device 10 through the air discharge passageway 19 to cool an individual or a space. As best shown in FIGS. 3, 4 and 5, the heat exchange assembly 15 contained in the lid 14 includes the heat exchanger 22 and at least one fan 24, two of which are included in the embodiment shown. The heat exchange assembly 15 may further include auxiliary elements, such as a pump 26, a power source 28, and a control panel 30. In an alternate embodiment described herein, the pump 26 is a submersible pump that extends into the insulated container 12 and is submersed in the coolant.

Flexible nozzles or discharge conduits 40 rotatably attached to the lid 14 and across air discharge openings 41 in the lid 14 allow the user to direct the cooled stream of air exiting through the air discharge passageway 19 as desired. The discharge conduits 40 include an elbow fitting 43 connected to the lid 14 and around the respective opening 41 that is swivelable relative to the openings 41, a compressible and expandable flexible hose 44, and an end cap 46, such as a louvered end cap, a conically shaped end cap, or another foreseeable end cap, to direct the cooled stream of air.

The insulated container 12 (e.g., cooler) is a receptacle or enclosure for containing a coolant within a main compartment 48 of the insulated container 12. The preferred coolant is chilled, liquid water in which the liquid water is mixed with ice as part of a mixture of ice and liquid water contained in the main compartment 48, but other foreseeable coolants or heat transfer fluids may be utilized. In addition, the insulated container 12 may be used to keep food and/or drink cool. The lid 14 is sized and formed to sealingly cover the main compartment 48 of the insulated container 12.

In the embodiment shown, the insulated container 12 comprises a rectangular shaped floor 49 and four sidewalls 50 extending from and formed on the floor 49 to form the main compartment 48 therein of the insulated container 12. The lid 14 forms the top surface of the air-cooling device 10 and extends in a plane generally parallel to the plane of the floor 49 of the insulated container 12 when in covering relationship with the insulated container 12 The insulated container 12, may also include an alternate cover (not shown) that does not include the components for cooling air.

The insulated container 12 is formed from a durable material and is at least partly or completely rigid. In one embodiment, the insulated container 12 includes an inner shell 52 connected to or formed with an outer shell 53. The inner shell 52 is formed from a waterproof material, such as molded plastic, polyester, nylon, a blend, or another foreseeable waterproof material, and may be a different material than the outer shell 53, which may also be waterproof. A molded plastic may form one or both of the inner shell 52 and the outer shell 53. The insulated container 12 also includes thermal insulating materials forming a rigid or semi-rigid frame onto which the waterproof material is joined. Such thermal insulating materials are known in the art and may be included between all or portions of the inner shell 52 and the outer shell 53.

The air-cooling device 10 may include molded-in handles, wheels, hand straps, backpack straps and/or other implements to enhance portability, open or closed compartments for storage, and/or devices incorporated into the insulated container 12 for a wired or a wireless connection to other electronic devices.

Figure 6:
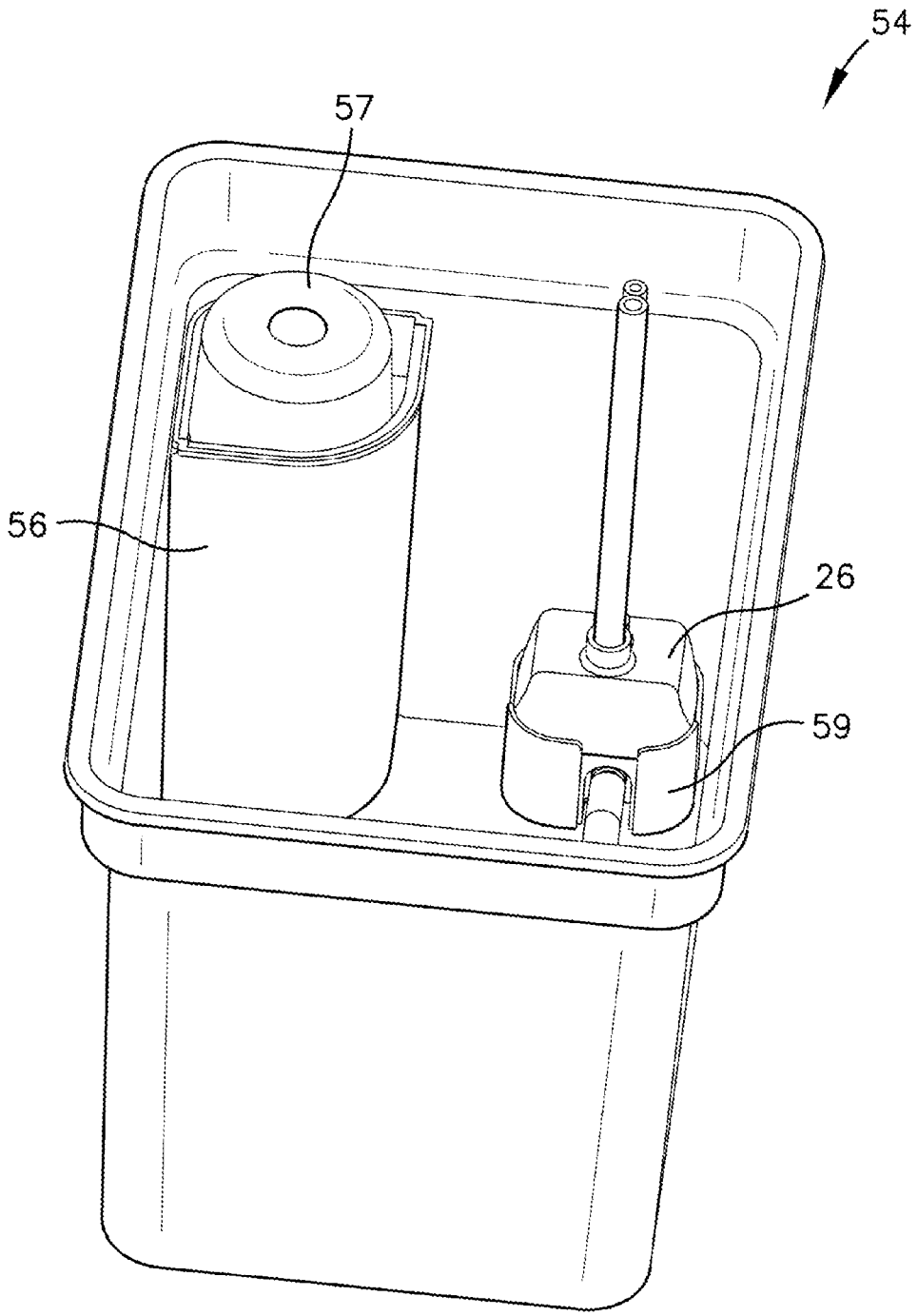
FIG. 6 is a perspective view of an embodiment of a hard, durable liner that may be incorporated into the insulated container of the portable air-cooling device in FIG. 1, including a coolant section and a pump holder for securing a submersible pump positioned in a main compartment of the insulated container.

In FIG. 6 a liner 54 is shown. It is contemplated that the liner 54 could be incorporated within the insulated container 12. The liner 54 may be formed from a hard and durable material to replace the inner shell 52 or may be used in addition to the inner shell 52. It is foreseen that the liner 54 could incorporate a distinct and separate coolant section or container 56 for the coolant, or for a secondary coolant such as dry ice, to be deposited therein. The separate coolant section may be referred to as a secondary coolant container or reservoir 56 and may be integrally formed in the liner 54. A coolant lid 57 may be provided to cover the reservoir 56. The coolant lid 57 may include a vent (not shown) to allow sublimated carbon dioxide to escape if dry ice is contained in the reservoir 56. As shown, a pump holder 59 may also be formed in or connected to the liner 54 for holding the pump 26 if the pump 26 is a submersible pump positioned in the main compartment 48 of the insulated container 12 and not in the lid 14.

Referring to FIGS. 2-5, the lid 14 includes an upper shell 60 mated to or joined with fasteners to a lower shell 62. The upper shell 60 and the lower shell 62 enclose the heat exchanger 22, the fans 24, and the pump 26, therebetween. In a preferred embodiment, the upper shell 60 and the lower shell 62 are preferably formed from molded plastic to protect the components and insulate the interior of the air-cooling device 10.

The upper shell 60 of the lid 14 includes the discharge openings 41 through which a cooled airflow exits or is forced from inside the air-cooling device 10. The openings 41 are dimensioned such that each opening 41 is approximately the same diameter of each fan 24 associated with the respective opening 41. In a preferred embodiment, two openings 41 are formed in and through the upper shell 60 of the lid 14 and aligned with the two fans 24 in the air discharge passageway 19. Flexible and extendable air discharge conduits 40 are rotatably connected to the upper shell 60 over or across the openings 41. The discharge conduits 40 each include an elbow fitting 43 that is rotatably joined to the upper shell 60 around the opening 41 by a rotatable joint or rotatable coupling 63 which allows the discharge conduits 40 to turn approximately 360-degrees about the radial center of each opening 41. In a preferred embodiment, the elbow fitting 43 directs the airflow at approximately a 90-degree angle relative to the airflow exiting the lid 14, but the elbow fitting 43 may be formed to direct the airflow at an angle greater than 90-degrees relative to the airflow exiting the lid 14 such that the cooled airflow is directed upward relative to the air-cooling device 10. The elbow fitting 43 is joined to an extendable and compressible hose 44 formed from a flexible, durable material, and the hose 44 is extendable, compressible, and able to bend at least 90-degrees to further direct the airflow as desired by a user. The hose 44 may be reinforced with a coiled wire. An end cap or nozzle 46 is joined to the hose 44 at a distal end thereof. In an embodiment, a plurality of louvers 66 on the end of the end cap 46 may be pivotable between an opened position, a closed position, and positions in between the opened and closed positions to adjust the direction of the airflow as desired.

In a preferred embodiment, the power source is a rechargeable battery 28 insertable into a battery chamber 67 which is formed in an upper surface of the upper shell 60 having electrical contacts 68 for contact with the battery 28 when inserted therein. Alternatively, an adapter (not shown) may be used to power the air-cooling device 10, such as from an electrical outlet or from an automobile auxiliary power outlet. It is foreseen that other power sources known by one skilled in the art, including solar panels as further described herein, may also be used to power the air-cooling device 10 or to charge the battery 28. A power port 69 with a cover is located in the top surface of the upper shell 60 with a variety of power receptacles, and may include, for example, a power output port such as a USB port for powering an electronic device, and a power input port such as a female power jack or charging port for powering the air-cooling device 10 or charging the battery 28.

The battery 28 is removable form the air-cooling device 10 and includes a release button 70 on the top surface of the battery 28. When inserted into the battery chamber 67, a catch connected to the release button 70 engages a notch in the battery chamber 67, locking or securing the battery 28 in the battery chamber 67. To remove the battery 28, a user presses the release button 70 and the catch releases the notch, releasing and partially ejecting the battery 28 from the battery chamber 67.

The control panel 30 is housed within a section of the upper shell 60 and is accessible by a user from the upper surface of the air-cooling device 10. The control panel 30 is a relay or switch between the battery 28 and the fans 24 and/or the pump 26. The control panel 30 may be used for independently activating the power to each of the fans 24 and independently controlling or adjusting the speed of each of the fans 24. The pump 26 may be independently activated by enabling or activating a cooling function of the control panel 30. In a preferred embodiment, the control panel 30 is a touch panel having tactile sensors sensitive to touch, force or pressure. It is foreseeable that the air-cooling device may be wirelessly operable via an interconnection to an electronic device, such as a smartphone or a remote control.

The air intake passageway 16 is formed in the upper shell 60 and extends between an air inflow grate 71 formed in an outer wall of the upper shell 60 and a discharge opening 72 connecting the air intake passageway 16 to the interior of the insulated container 12. The fans 24 draw the ambient air through openings of the inflow grate 71, through the air intake passageway 16 and out the discharge opening 72 of the air intake passageway 16. The air intake passageway 16 is configured to direct a stream of ambient air or an airflow downward into the interior of the insulated container 12 of the air-cooling device 10 and toward and across the coolant contained therein. As shown in FIG. 4, the ambient air may be cooled via two stages of cooling, including a first stage of cooling or direct cooling and a second stage of cooling or indirect cooling. Direct cooling includes cooling by directing the ambient airflow across the coolant in the insulated container 12. Direct cooling, as used herein, includes cooling through direct contact or direct transfer of heat between the coolant and the airflow. Direct cooling may also be referred to as ambient cooling or pre-cooling. In the main compartment 48, the airflow moves past the coolant where the first stage of cooling occurs. As explained below, the airflow is then drawn through the heat exchanger 22, entering the second stage of cooling or indirect cooling, which, as used herein, includes cooling by drawing or directing the airflow across the heat exchanger. The cooled airflow is expelled from inside the air-cooling device 10, through the fans 24, the openings 41 in the lid 14 and the discharge conduits 40, to the exterior of the air-cooling device 10.

Figure 7:
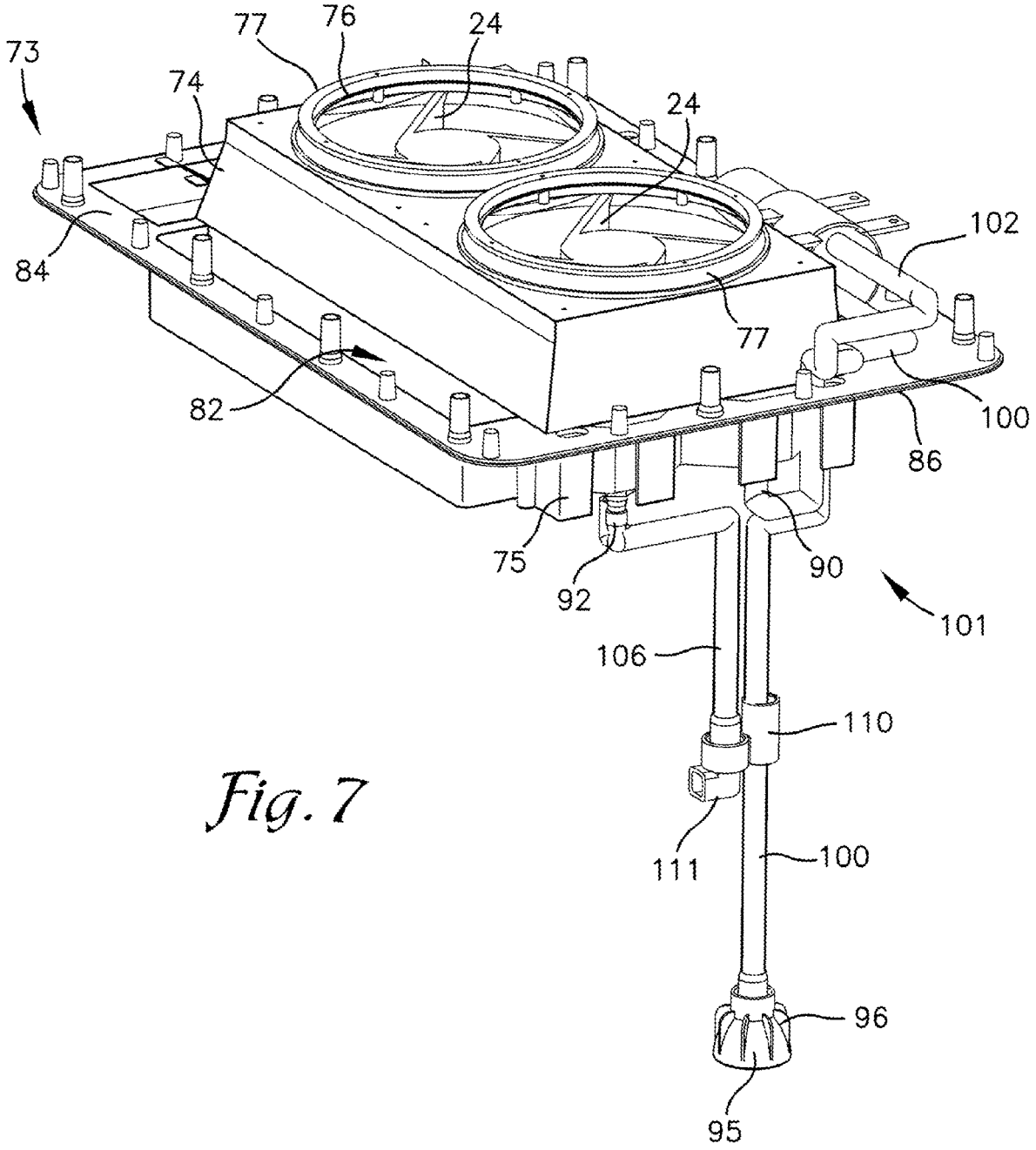
FIG. 7 is a perspective view of a heat exchange assembly housing that encloses the heat exchangers and the fans in the lid shown in FIG. 1, including coolant circulation lines extending therefrom.

A heat exchange assembly housing 73 enclosing the fans 24 and heat exchanger 22 within the upper shell 60 and the lower shell 62 of the lid 14 is shown in FIG. 7. The heat exchange assembly housing 73 includes an upper housing 74 enclosing the fans 24 and a lower housing 75 enclosing the heat exchanger 22. The upper housing 74 includes two circular openings 76 formed therein, each opening 76 extending in axial alignment with and over a respective fan 24. The housing openings 76 are each surrounded and defined by a circular rim or track 77 projecting upward from an upper surface of the upper housing 74. Each circular track 77 is aligned with and extends through an aligned opening 41 in the upper shell 60. The rotatable coupling 63 of each discharge conduit 40 is rotatably connected to a respective one of the circular tracks 77.

In a preferred embodiment, two variable speed fans 24, including an associated case 78 of each fan 24, are mounted within the upper housing 74 and the fans 24 are each aligned with openings 41 and 76. The fans 24 are mounted to the upper housing 74 between the heat exchanger 22 and the openings 41 and 76, such that the fans 24 draw the stream of air through the heat exchanger 22 and through each fan 24, and then push the cooled stream of air out through the aligned openings 41 and 76. In this embodiment, the heat exchanger 22 extends horizontally across the intake side or area of both of the fans 24. A vertically extending dividing wall 79 is formed on and within the upper housing 74, separating the fans 24 and the airflow through each fan 24. It is foreseen that the heat exchanger 22 could extend only across the intake area of one of the fans 24 such that after the airflow is directly cooled, one of the fans 24 draws air through the heat exchanger 22 for indirect cooling, and/or the other of the fans 24 draws air from the interior of the insulated container 12 without being cooled by the heat exchanger 22.

The upper housing 74 and the lower housing 75 are joined to form the heat exchange assembly housing 73. The upper housing 74 includes an outward extending lower flange 84 that is integral with or fastens to an outward extending upper flange 86 of the lower housing 75. A flange 88 formed on the lower shell 62 also fastens or attaches the lower shell 62 to the heat exchange assembly housing 73. The heat exchange assembly housing 73 and the lower shell 62 are joined by fasteners threaded into bosses 89 extending downward from the inside surface of the upper shell 60, thus joining the shells 60 and 62 and the heat exchange assembly housing 73 and enclosing components of the air-cooling device 10. The upper housing 74 and the lower housing 75 have a coextensive interior area which generally defines the air discharge passageway 19 such that the airflow extends and flows through the lower housing 75 to the upper housing 74.

An elongate opening or channel 82 extends through the lower flange 84 of the upper housing 74 and the upper flange 86 of the lower housing 75 generally in alignment with the air intake passageway 16 such that the air intake passageway 16 extends through the flanges 84 and 86.

The heat exchanger 22, which is connected to the pump 26, is mounted within the portion of the air discharge passageway 19 extending through the lower housing 75. The heat exchanger includes a coolant inlet port 90, a coolant outlet port 92, one or more circuitous heat exchange conduits 93 connected to and extending between the inlet port 90 and outlet port 92 and a plurality of heat absorbing fins 94 projecting from each heat exchange conduit 93. In the embodiment shown, the pump 26 is secured between the upper housing 74 of the heat exchange assembly housing 73 and the upper shell 60 of the lid 14. A coolant conduit or plurality of coolant circulation lines 101 circulate the coolant to and from the heat exchanger 22 and include a pump intake line 100, a pump discharge line 102, and a coolant return line 106. The pump intake line 100 extends from the pump 26 to just above the bottom interior surface of the main compartment 48 of the insulated container 12 and an inlet fitting 95 is joined to the end of the pump intake line 100. The inlet fitting 95 is formed in the shape of a bell or an inverted cup. Eight exterior ribs or flanges 96 extend from the exterior surface of the inlet fitting 95 and eight interior ribs or flanges 97 extend from the interior surface of the inlet fitting 95 toward the center. The flanges 96 and 97 create a filter or a screen so that solid objects, such as ice or debris, cannot pass through the pump intake line 100 to the pump 26 as the pump draws the coolant to the pump 26 from the insulated container 12. The pump 26 pressurizes the coolant and pushes the coolant through the pump discharge line 102 to the inlet port 90 of the heat exchanger 22. The coolant flows through the heat exchanger 22 and exits the heat exchanger through an outlet port 92 connected to the return line 106 that expels the coolant into the insulated container 12. The coolant exiting the heat exchanger 22 is expelled into the main compartment 48 spaced a distance from the pump intake line 100. In the embodiment shown, a pipe holder 110 connects the return line 106 to the pump intake line 100, preventing movement and providing support to the lines 100 and 106. A pipe elbow 111 is joined to the end of the return line 106 and directs the coolant exiting the return line 106 away from the coolant in the area of the pump intake line 100. The stream of air or airflow is simultaneously drawn through the heat exchanger 22 by the fans 24 and heat in the stream of air is absorbed by the coolant flowing through the heat exchanger 22. The heat exchanger fins 94 and the coolant flowing through the heat exchanger 22 absorb heat from the airflow as the airflow is drawn through the heat exchanger 22, cooling the airflow to a final cooled airflow.

The heat exchanger 22 lies in a horizontal position across an inlet opening 112 formed in the bottom surface of the lower housing 75 for the heat exchanger assembly 15 and generally parallel to the base of the insulated container 12. The opening 112 formed in the bottom surface of the lower housing 75 is aligned with an opening 113 formed in the bottom surface of the lower shell 62 of lid 14 and has dimensions that are approximately the same size or just larger than those of the bottom surface of the heat exchanger 22 such that the airflow from the interior of the insulated container 12 flows through the heat exchanger 22. The openings 112 and 113 are adjacent to the discharge opening 72 for the air intake passageway 16. The discharge opening 72 of the air intake passageway 16 and the opening 113 in the lower shell 62 of the lid 14 may be covered by a filter, mesh, or lower shell grate 114 preventing debris from entering the insulated container 12 and/or from entering the airflow through the heat exchanger 22. In the embodiment shown, a coolant circulation line cover 120 covers portions of the coolant circulation lines 101 and the inlet port 90 and outlet port 92 of the heat exchanger 22.

Figure 8:
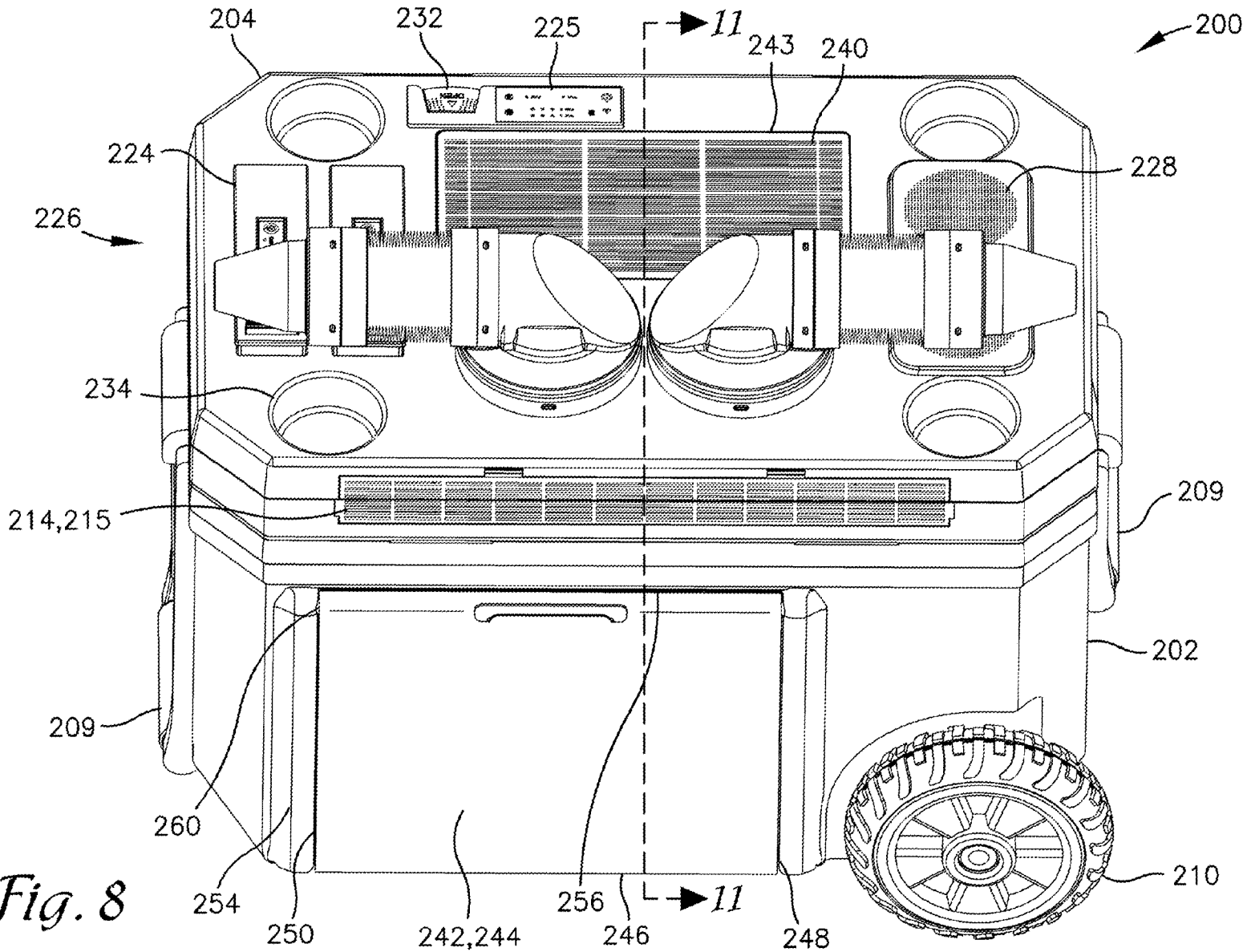
FIG. 8 is a perspective view of an embodiment of a portable air cooling device having a lid and an insulated container with wheels, including a solar panel mounted to a top of the lid and a solar panel hingedly mounted to a sidewall of the insulated container.
Figure 9:
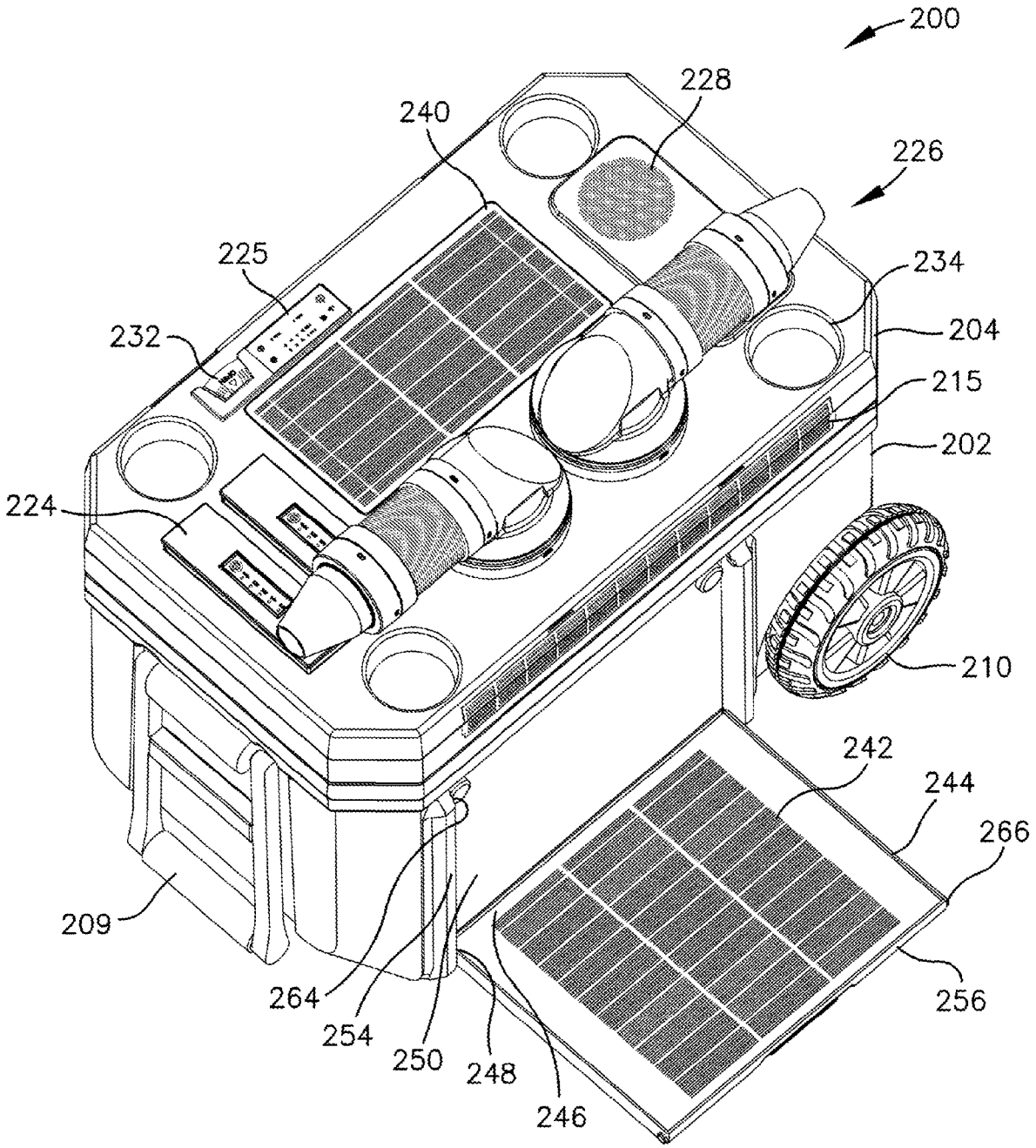
FIG. 9 is a view of the portable air cooling device in FIG. 8, with the solar panel mounted to the sidewall in an open position.
Figure 10:
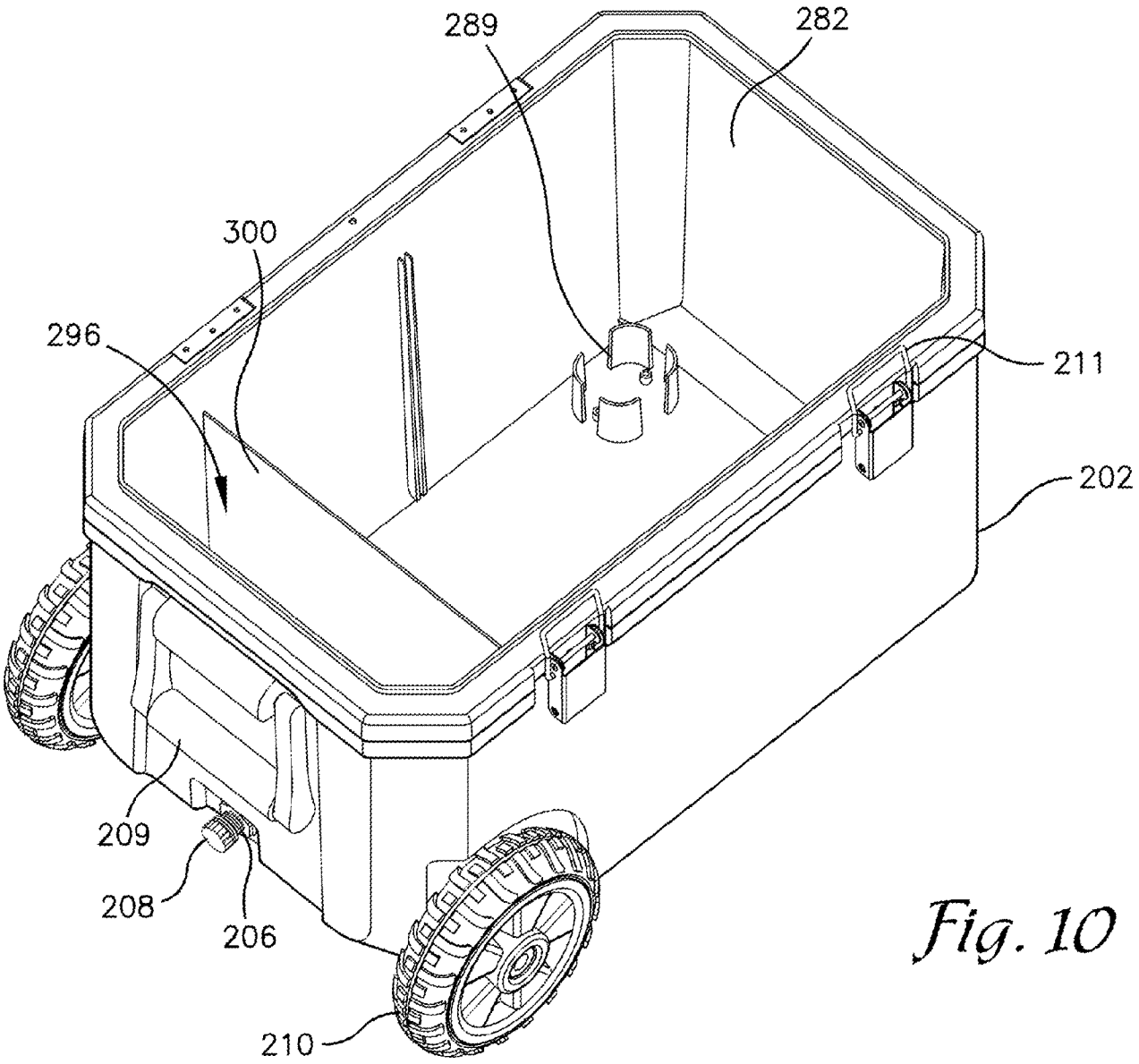
FIG. 10 is a view from above the insulated container of the portable air-cooling device in FIG. 8, including a secondary reservoir and a pump holder located within the insulated container.

In an alternate embodiment shown in FIGS. 8-10, the air-cooling device 200 includes a base or container 202 and a lid 204 having a heat exchange assembly contained therein. The lid 204 and the heat exchange assembly are constructed similarly to the heat exchange assembly 15 incorporated into the air-cooling device 10, described herein. The container 202 is formed similarly to an insulated cooler known by one skilled in the art, such as, for example, a hard plastic cooler, an injected molded cooler, a rotational molded cooler, or a metal cooler, for keeping food and drink cool, and includes an interior and an exterior shell having a cavity formed therebetween that is filled with a hard foam insulation, such as extruded polystyrene, polyurethane, or another insulating foam. The container 202 is configured to hold or contain a coolant or heat transfer fluid and includes a drain assembly 206 extending through a sidewall of the container. The drain assembly 206 provides a conduit through which the coolant can be drained and includes a sealable cap 208 that is positionable in the drain assembly 206 to contain the coolant in the device 200.

The cooling device 200 may include a molded-in handle, at least one pivotable pull and/or carry handle 209, wheels 210, and/or other implements to enhance portability and use. Molded-in handles, if utilized, may include an integrated handle projection and/or indentation, such as, for example, a projection and an indentation on a side or front surface of the lid 204 or surface of the container 202 to facilitate opening the lid 204 or carrying the device 200. At least one of the pivotable pull handles may be extendable for rolling the device 200 to a desired location. In a preferred embodiment, the wheels 210 include traction features and are sized to raise the device 200 above a surface and to facilitate rolling the device 200 over uneven ground.

The lid 204 is formed to sealingly cover the container 202. The lid 204 includes one or more latches 211, such as, for example, draw latches, T-latches, or other known mechanical fasteners, to secure the lid 204 in a sealed position on the container 202. In an embodiment, door limiter straps are coupled to the lid 204 and the container 202 to limit the lid 204 from opening 90° or more to prevent inadvertent closing of the lid or opening of the lid beyond the vertical position that may result in the device 200 tipping.

Figure 11:
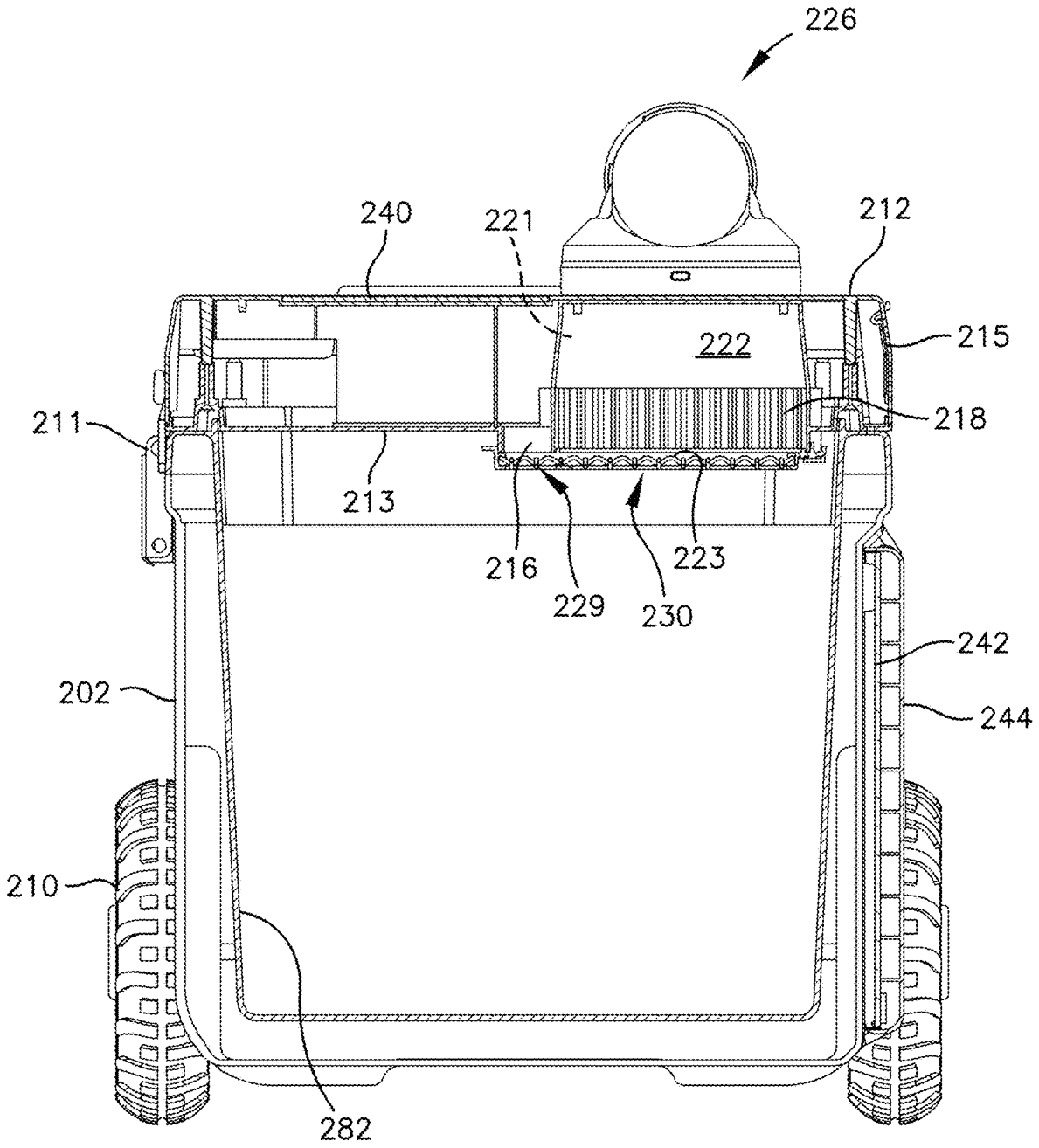
FIG. 11 is a cross-sectional view of the portable air-cooling device along line 11-11 in FIG. 8, showing the heat exchanger in the lid.

As shown in FIG. 11, the lid 204 includes an upper shell 212 and a lower shell 213 coupled together to enclose a heat exchanger 218 and at least one fan 221 therebetween. In the embodiment shown, a heat exchange assembly housing 73 is not employed as shown in the previous embodiment to house the at least one fan 221 and the heat exchanger 218, but rather the upper shell 212 and the lower shell 213 include various walls extending therefrom for enclosing the at least one fan 221 and the heat exchanger 218. In the embodiment shown, two fans 221 are positioned between the upper shell 212 the lower shell 213, and a vertically extending dividing wall 222 extends from the upper shell 212, separating the fans 221 and the airflow through each fan 221. In a preferred embodiment, the upper shell 212 and the lower shell 213 are formed from molded plastic to protect the components and insulate the interior of the air-cooling device 200. The pump may be enclosed in the lid 204 as previously described, or the pump may be a submersible pump positioned in the coolant in the container 202, such that the coolant is pumped through the plurality of coolant circulation lines 101, including a heat exchanger inlet line from the submersible pump to the heat exchanger and a heat exchanger outlet line from the heat exchanger 218 to the container 202.

Apertures 214 formed in an air inflow grate 215 of the lid 204 allow a stream of ambient air to be drawn into the device 200 and cooled by at least the heat exchanger 218. In the embodiment shown in FIG. 11, an air intake passageway or air intake channel 216 for directing the stream of ambient air into the container 202 is formed in the lid 204. The stream of ambient air drawn through the channel 216 is directed around an enclosure housing the heat exchanger 218 and the fans 221 and downward though an air intake passageway opening 229 in the lid 204 toward the coolant and then back through an air discharge passageway opening 230 in the lid 204 and past the heat exchanger 218. The cooled stream of air is exhausted from the device 200 to cool an individual or a space. In the embodiments shown, a filter or mesh or grate 223 extends across the air intake passageway opening 229 and the air discharge passageway opening 230 and functions to prevent debris or other contaminants from entering and circulating through the heat exchanger 218 with the cooled airflow.

Figure 12A:
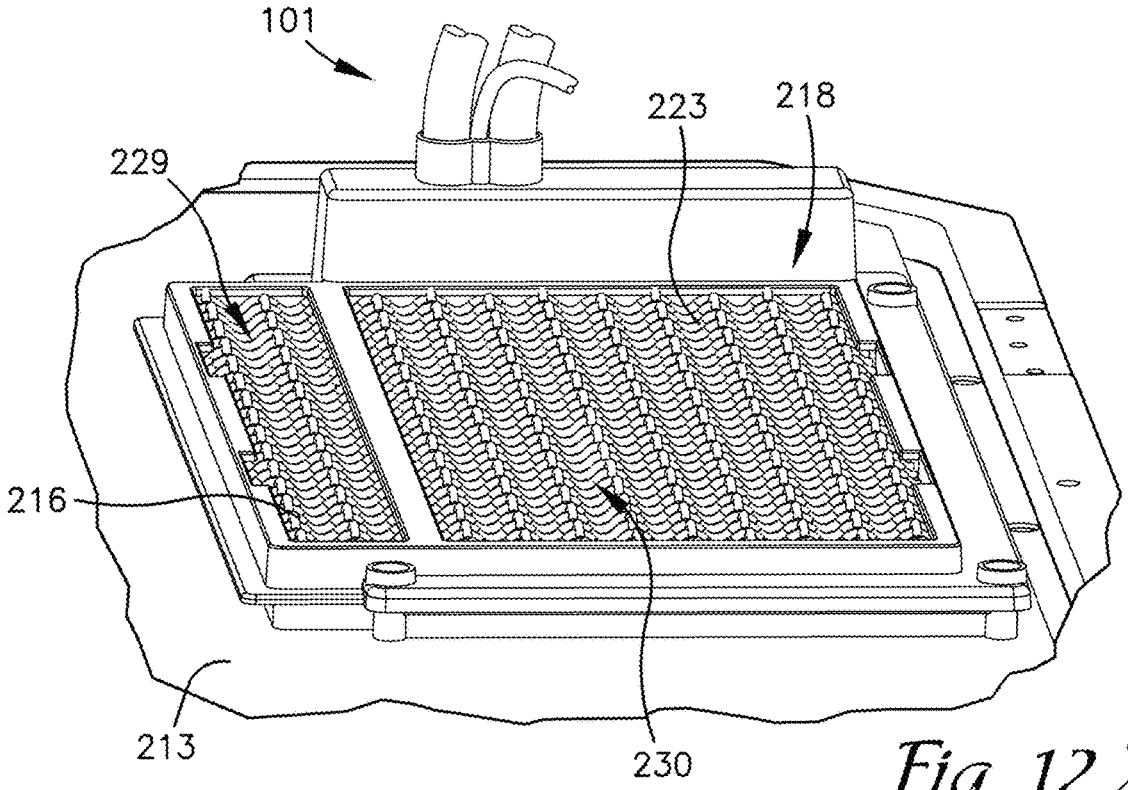
FIGS. 12A, 12B, and 12C are fractional views of an alternate embodiment of a lid that includes a plenum chamber formed by a plenum enclosure that directs an airflow through the lid.
Figure 12B:
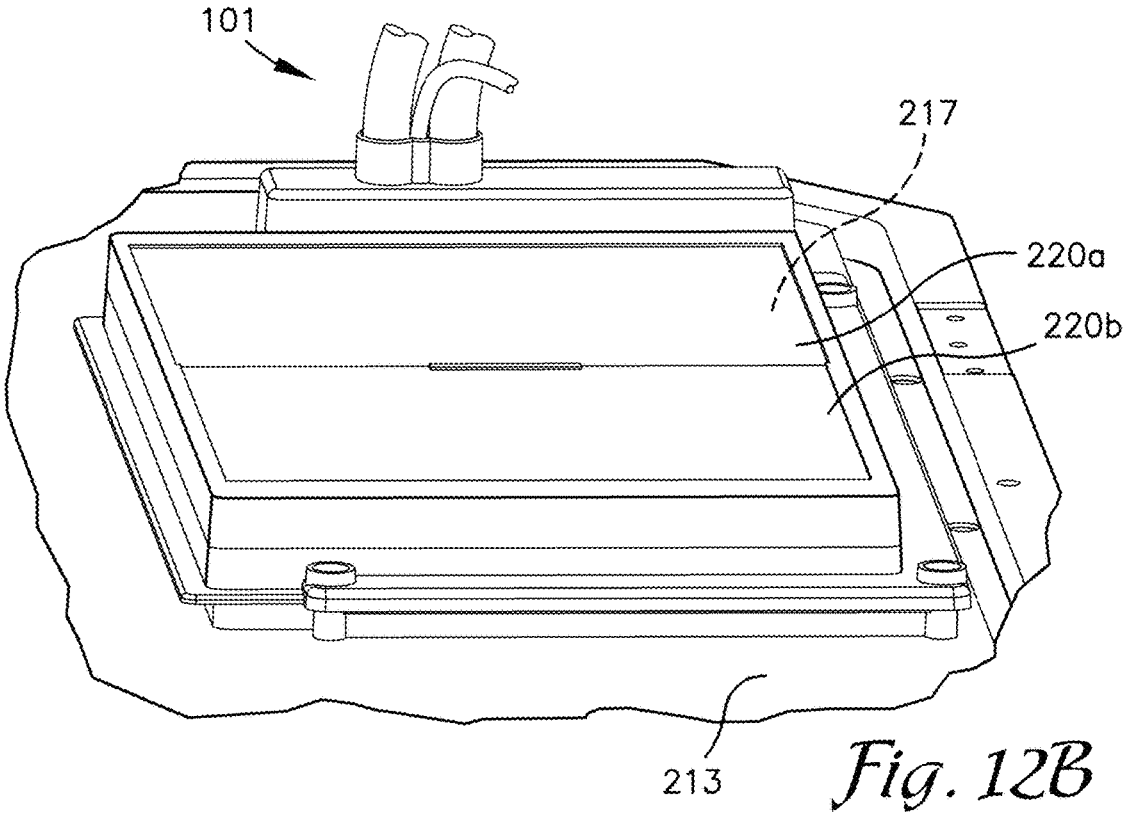
Figure 13:
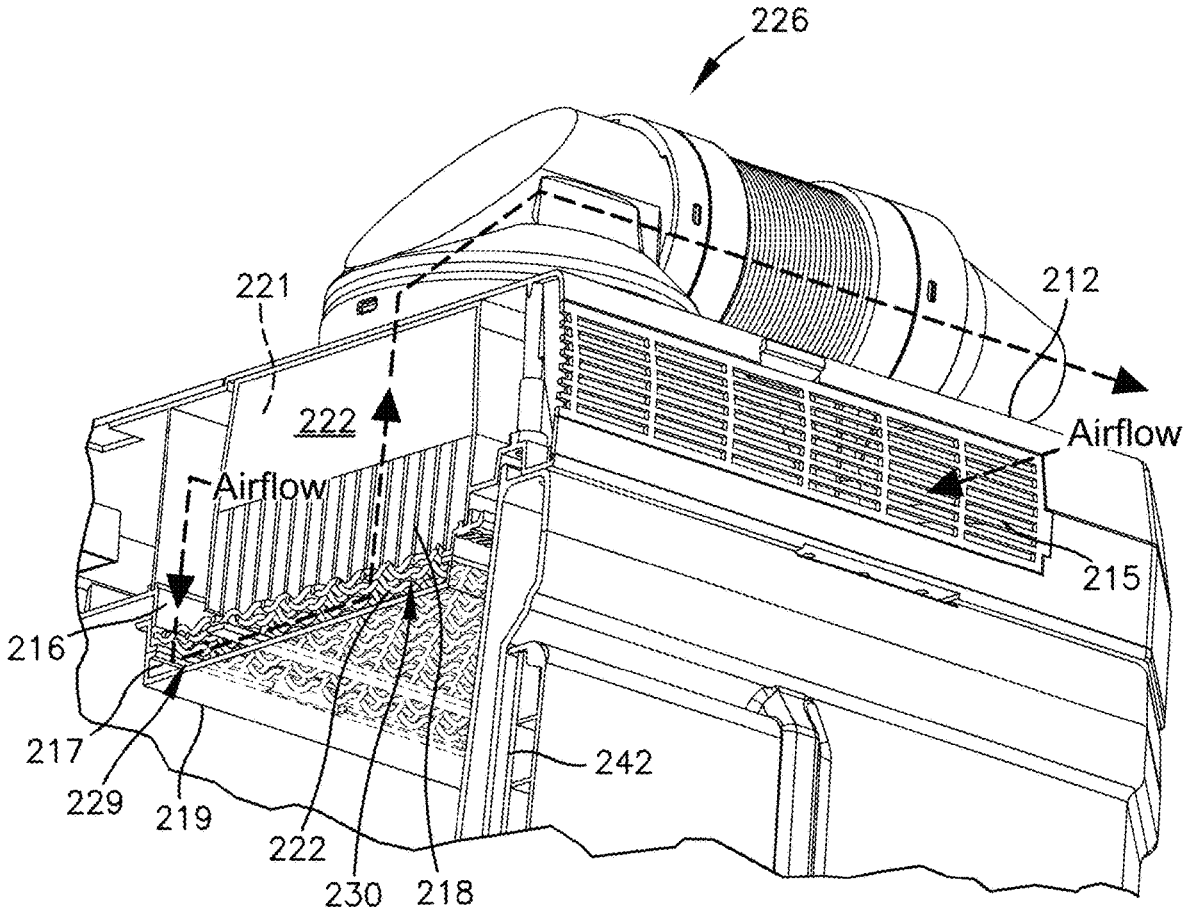
FIG. 13 is a fractional view of the lid shown in FIGS. 12A, 12B, and 12C, showing an airflow through the lid and the plenum chamber.
Figure 14:
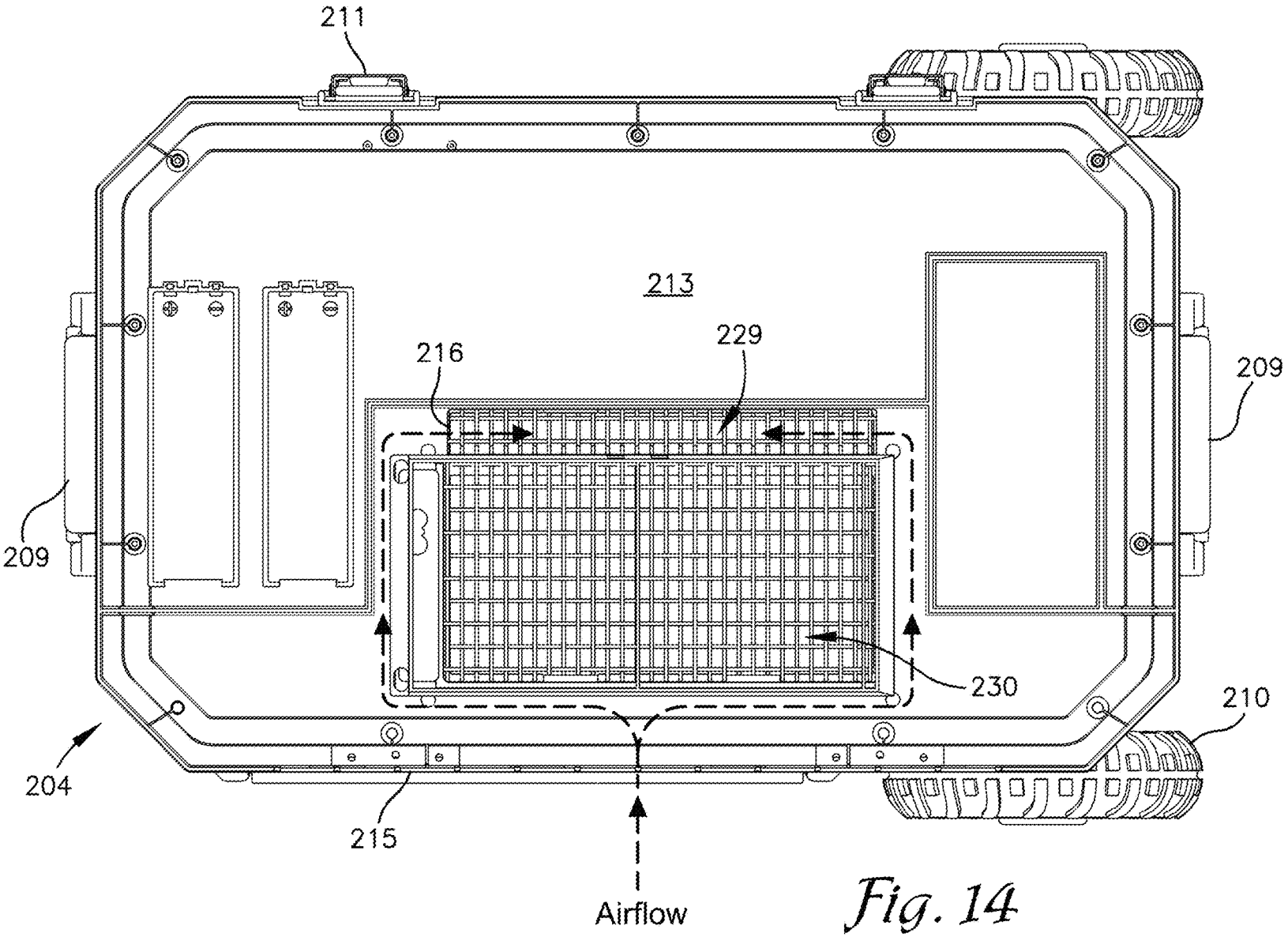
FIG. 14 is a plan view of the lid shown in FIGS. 11 and 13 showing an airflow through a channel in the lid that directs the airflow around a housing formed around the fan and heat exchanger. The fan and the heat exchanger have been removed.

In an alternate embodiment shown in FIG. 12B, a plenum chamber 217 formed by a plenum enclosure 219 in covering relationship with openings in the lower shell 213 extends across the air intake channel 216 and the heat exchanger 218 to direct ambient air or the airflow from the channel 216 directly to the heat exchanger 218 for cooling. The plenum enclosure 219 may be coupled to the lid 204 by hook, latches, or other attachment means to secure the plenum enclosure 219 to the lower shell 213. The airflow pathway through the plenum chamber 217 is shown in FIGS. 13 and 14. In this embodiment, the plenum enclosure 219 is able to prevent the ambient air from being drawn into the interior of the container 202 and across the coolant, which prevents the airflow from increasing a temperature of the coolant in the device 200.

In FIG. 12A the plenum enclosure 219 is removed and shows the air intake passageway opening 229 from the air intake channel 216 and the air discharge passageway opening 230 in alignment with the heat exchanger 218. The airflow drawn by the fans 221 into the air intake channel 216 is drawn through the air intake passageway opening 229, the plenum chamber 217, the air discharge passageway opening 230, and across the heat exchanger 218. In the drawing shown, the mesh or grate 223 extends across the air intake passageway opening 229 and the air discharge passageway opening 230, but it is understood that the mesh 223 is optional. Alternatively, a filter may be positioned adjacent to the air inflow grate 215 or at another position such that the airflow is filtered before being drawn through the heat exchanger 218.

Figure 12C:
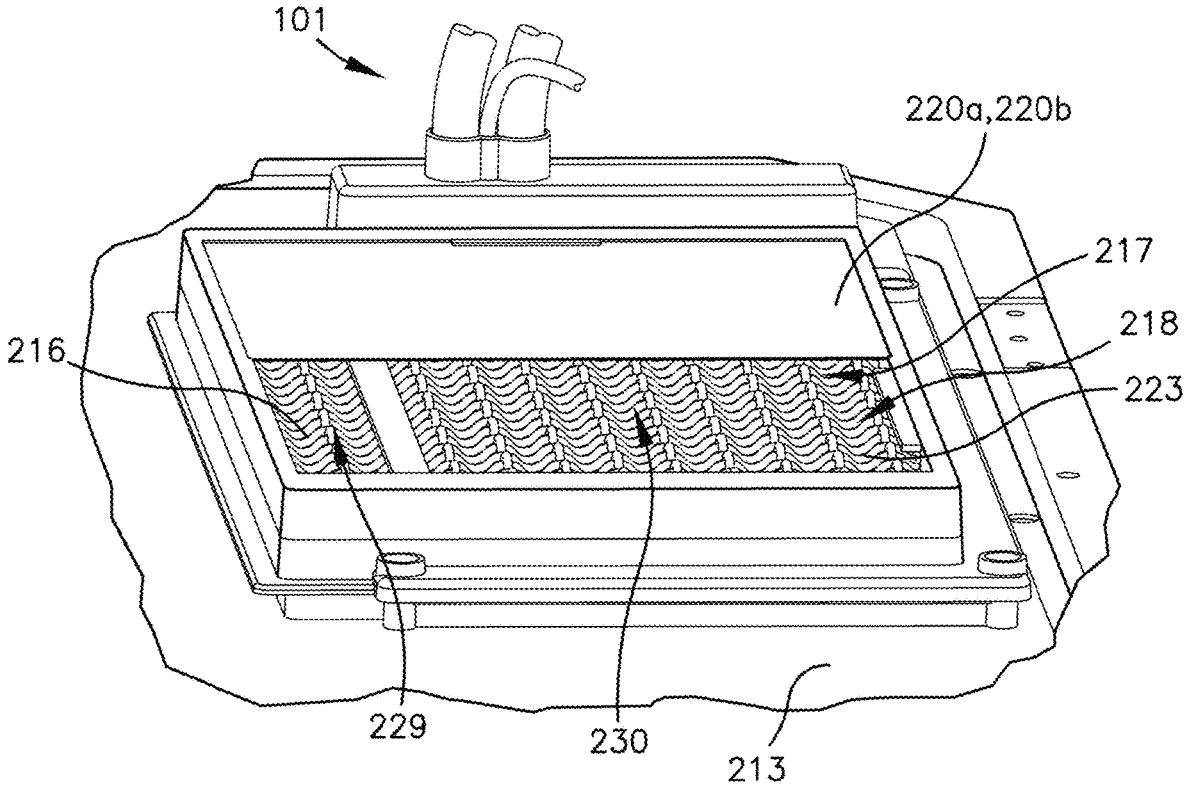

The plenum enclosure 219 may be formed from a single component that is not openable, as described above, or may be formed with an opening or openable such that an airflow is able to circulate from the air intake channel 216 to the interior of the container 202 and from the interior of the container 202 through the air discharge passageway 19. It is foreseen that airflow regulating means, including louvers, shutters, or slidable coverings, could be used to regulate or control the airflow to and from the container 202. FIGS. 12B and 12C show an embodiment of the plenum enclosure 219 that includes a fixed cover 220*a* and a slidable cover 220*b* that is slidable relative to the fixed cover 220*a* and selectively positionable in an open position to open the plenum chamber 217 to the interior of the container 202 or in a closed position. When the slidable cover 220*b* is in the closed position, the airflow is drawn through the device 200 similar to that described above with regard to the plenum enclosure 219 that is not openable and does not have an opening. When the slidable cover 220*b* is in the open position, the airflow from the air intake channel 216 circulates to the interior of the container 202, increasing the airflow through the container 202 and from the device 200. A cooled airflow from inside the container 202 can be vented through the air discharge passageway 19, with or without subsequent cooling of the airflow in the heat exchanger 218, meaning that a cooled airflow from the device 200 is achievable without using the pump to circulate coolant through the heat exchanger 218. Further, in an event that condensate is formed in the heat exchanger 218, the condensate may be drained into the container 202 by opening the slidable cover 220*b*. Allowing the airflow to circulate through the container 202 when the plenum enclosure 219 is in the open position does have a drawback of more quickly warming the coolant in the container 202, as compared to when the slidable cover 220*b* is in the closed position.

The embodiment of the lid 204 shown in FIGS. 8-10 includes two rechargeable batteries 224 that provide power to the components of the device 200, a control panel 225 and two flexible nozzles 226 extending therefrom to allow the user to direct the exiting cooled airflow as desired. The lid 204 may also include a variety of other components, including, for example, speakers 228 contained in the lid 204, a power port 232 connected to the batteries 224 for charging a device, cup holders 234 and/or other foreseeable components. In an embodiment, a remote control (not shown) is connectable to the device 200 for controlling the heat exchanger assembly, including the pump, and each fan, individually. The remote control may also control a connection to the speakers 228, such as a wireless connection for transferring calls or music. The lid 204 may include a holder for the remote control, and the lid 204 and the remote control may include one or more mechanisms for removably securing the remote control, including magnets, slots/tabs, and other mechanisms that would be understood by one skilled in the art to retain the remote control.

The rechargeable batteries 224 are electrically connected to one or more first solar panels 240 coupled to the lid 204 and/or one or more second solar panels 242 hingedly mounted to a sidewall of the container 202. The first and second solar panels 240 and 242 are configured to convert solar energy into electricity and to provide power to charge the rechargeable batteries 224. In the embodiment shown, the first solar panel 240 is mounted to a top of the lid 204. In one embodiment, the first solar panel 240 is secured in a depression or recess 243 formed in the lid 14 having a shape and a depth to securely fit the first solar panel 240 such that the first solar panel 240 is substantially flush with a top surface of the lid 204. In one embodiment, the first solar panel 240 may be hingedly coupled to the lid 204 such that the first solar panel 240 is able to be pivoted toward the sun.

The at least one second solar panel 242 is secured to a fold-out support panel 244 having a first edge 246 that is pivotable or rotatable about a hinge or a joint 248 having a horizontal axis positioned near the bottom of the container 202. A recess 250, formed in the sidewall of the container 202 or formed between raised members 254 extending from the sidewall of the container 202, is sized to contain the second solar panel 242 and the support panel 244 when the support panel 244 is rotated upward and into a vertical position to store the second solar panel 242. In a preferred embodiment, the stored support panel 244 and second solar panel 242 are substantially flush with the sidewall of the container 202 or the raised members 254. A second edge 256, opposite the first edge 246 of the support panel 244, secures the vertically rotated or stored support panel 244 to the container 202 in a closed or stored position via a fastening mechanism 260. In the embodiment shown, the fastening mechanism 260 includes receptors comprising slots 264 extending into the raised members 254 that are positioned such that pins or tabs 266 extending from each end of the second edge 256 of the support panel 244 are securable in the slots 264 in an interference fit to secure the support panel 244 and the second solar panel 242 in the stored position. It is foreseeable that an alternate fastening mechanism could be used to secure the support panel 244 in the stored position. When the support panel 244 is rotated downward or folded out into a substantially horizontal position, the second edge 256 of the second solar panel 242 may rest on a surface, such as the ground or a table, and the second solar panel 242 is able to absorb energy from the sun to create electrical energy.

In one embodiment, the first solar panel 240 and the second solar panel 242 are connected to the batteries 224 via a charge controller (not shown) that regulates amperage and voltage delivered to the batteries 224. The charged batteries 224 are able to provide electrical power to the components of the device 200, which includes the heat exchange assembly 15, including the fans 24, the pump 26, and the control panel 225, the power port 232, and the speakers 228.

Similar to the embodiment previously described with respect to FIG. 6, in an embodiment shown in FIG. 10, an inner shell 282 includes a pump holder 289 formed in or connected to the inner shell 282 and configured for holding the submersible pump in the container 202. It is foreseeable that a protective cover for the submersible pump may be utilized for filtering, protection, and securing the submersible pump to the container 202. The container 202 may also include a secondary coolant container or reservoir 296 for containing a coolant. In the embodiment shown in FIG. 10, the reservoir 296 is formed by a wall or divider 300 that extends across a portion of the container 202. Additional divider supports may be coupled to the inner shell 282 for sectioning of the container 202.

It is foreseen that the components described herein could be formed from a variety of materials and using a variety of methods. Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the claims.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

Having thus described the invention, what is claimed as new and desired to be secured by Letters Patent is as follows:

1. A portable air-cooling device, comprising:

an insulated base having an interior compartment for holding a liquid coolant;

a lid formed to cover the insulated base, wherein the lid includes:

a heat exchanger extending across an air discharge passageway extending through the lid, the heat exchanger including a coolant conduit with a plurality of heat transfer fins projecting from the coolant conduit;

a pump flow connected to the coolant conduit for pumping the liquid coolant from the interior compartment of the insulated base through the coolant conduit and back to the interior compartment of the insulated base; and one or more air discharge openings formed in the lid in communication with the air discharge passageway;

one or more discharge conduits, each of the one or more discharge conduits rotatably coupled to the lid around one of the one or more air discharge openings of the lid, wherein the one or more discharge conduits are flexible and extendable by a user;

at least one fan extending across the air discharge passageway for drawing a stream of air through an air intake passageway in the lid and through the heat exchanger and out the one or more air discharge openings and through the one or more discharge conduits which are positionable by the user to direct the stream of air; and a plenum chamber including a covering structure that is selectively positionable in an open position and in a closed position, wherein when the covering structure is in the open position, at least a portion of the stream of air from the air intake passageway in the lid is directed to the interior compartment of the insulated base.

2. The portable air-cooling device of claim 1, further comprising a rechargeable power source.

3. The portable air-cooling device of claim 2, further comprising at least one solar panel electrically coupled to the rechargeable power source.

4. The portable air-cooling device of claim 3, wherein the at least one solar panel includes a solar panel mounted on the lid.

5. The portable air-cooling device of claim 3, wherein the at least one solar panel includes a solar panel hingedly mounted to a sidewall of the insulated base.

6. The portable air-cooling device of claim 1, wherein the at least one fan and the pump are each independently controllable via a control panel.

7. The portable air-cooling device of claim 1, wherein the lid includes the plenum chamber that directs the stream of air from the air intake passageway in the lid to the heat exchanger.

8. The portable air-cooling device of claim 1, wherein when the covering structure of the plenum chamber is in the closed position, the stream of air from the air intake passageway in the lid is directed to the heat exchanger without passing through the interior compartment of the insulated base.

9. The portable air-cooling device of claim 1, wherein the insulated base comprises a secondary coolant section for a secondary coolant.

10. A portable air-cooling device, comprising:

an insulated base for holding a liquid coolant;

a pump operable to pump the liquid coolant;

a lid connected to the insulated base and selectively positionable in covering relationship with an interior compartment formed in the insulated base;

an air intake passageway formed in the lid through which a stream of air is drawn through the lid;

a heat exchanger for cooling the stream of air, the heat exchanger connected to the pump;

one or more fans for drawing the stream of air through the air intake passageway and the heat exchanger;

one or more openings in the lid for exhausting the stream of air passing through the heat exchanger;

one or more flexible and extendable discharge conduits rotatably coupled to the one or more openings formed in the lid;

a solar panel mounted on the portable air-cooling device and connected to a rechargeable battery operatively connected to the pump and the one or more fans, the solar panel operable to charge the rechargeable battery; and a plenum chamber including a covering structure that is selectively positionable in an open position and in a closed position, wherein when the covering structure is in the open position, at least a portion of the stream of air from the air intake passageway in the lid is directed to the interior compartment of the insulated base.

11. The portable air-cooling device of claim 10, further comprising a control panel configured to control each of the one or more fans and the pump, independently.

12. The portable air-cooling device of claim 10, wherein the lid includes the plenum chamber that directs the stream of air from the air intake passageway to the heat exchanger.

13. The portable air-cooling device of claim 10, wherein when the covering structure of the plenum chamber is in the closed position, the stream of air from the air intake passageway in the lid is directed to the heat exchanger without passing through the interior compartment of the insulated base.

14. The portable air-cooling device of claim 10, wherein the insulated base includes a secondary coolant section.

15. An air-cooling lid configured to be mounted on an insulated base having an interior compartment configured to contain a liquid coolant, the air-cooling lid comprising:

a top shell and a bottom shell coupled together to form the air-cooling lid;

an air inflow grate formed in a sidewall of the air-cooling lid for drawing a stream of air into an air intake passageway in the air-cooling lid, the air inflow grate including a plurality of apertures formed therein;

an air discharge passageway formed in the air-cooling lid and in communication with the air inflow grate;

a heat exchanger extending across the air discharge passageway in the air-cooling lid and coupled to a pump operable to pump the liquid coolant though the heat exchanger;

a first fan positioned for advancing the stream of air through the heat exchanger;

a first opening formed in the top shell for exhausting the stream of air passing across the heat exchanger;

a flexible and extendable first conduit coupled to the first opening in the air-cooling lid;

a power source, the power source configured to power each of the first fan and the pump; and a plenum enclosure that includes a covering structure that is selectively positionable in an open position or in a closed position, wherein in the closed position the stream of air from the air intake passageway in the air-cooling lid is directed to the heat exchanger without passing through the interior compartment of the insulated base, and in the open position at least a portion of the stream of air from the air intake passageway in the air-cooling lid is directed to the interior compartment of the insulated base; wherein:

at least the heat exchanger and the first fan are positioned between the top shell and the bottom shell that form the air-cooling lid.

16. An air-cooling lid configured to be mounted on an insulated base having an interior compartment configured to contain a liquid coolant, the air-cooling lid comprising:

a top shell and a bottom shell coupled together to form the air-cooling lid;

an air inflow grate formed in a sidewall of the air-cooling lid for drawing a stream of air into an air intake passageway in the air-cooling lid, the air inflow grate including a plurality of apertures formed therein;

an air discharge passageway formed in the air-cooling lid and in communication with the air inflow grate;

a heat exchanger extending across the air discharge passageway in the air-cooling lid and coupled to a pump operable to pump the liquid coolant though the heat exchanger;

a first fan positioned for advancing the stream of air through the heat exchanger;

a first opening formed in the top shell for exhausting the stream of air passing across the heat exchanger;

a flexible and extendable first conduit coupled to the first opening in the air-cooling lid; and a power source, the power source configured to power each of the first fan and the pump; wherein:

the air intake passageway is configured to advance the stream of air around an enclosure of the heat exchanger and through an air intake passageway opening prior to the stream of air advancing through the heat exchanger; and at least the heat exchanger and the first fan are positioned between the top shell and the bottom shell that form the air-cooling lid.

17. An air-cooling lid configured to be mounted on an insulated base having an interior compartment configured to contain a liquid coolant, the air-cooling lid comprising:

a top shell and a bottom shell coupled together to form the air-cooling lid;

an air inflow grate formed in a sidewall of the air-cooling lid for drawing a stream of air into an air intake passageway in the air-cooling lid, the air inflow grate including a plurality of apertures formed therein;

an air discharge passageway formed in the air-cooling lid and in communication with the air inflow grate;

a heat exchanger extending across the air discharge passageway in the air-cooling lid and coupled to a pump operable to pump the liquid coolant though the heat exchanger;

a first fan positioned for advancing the stream of air through the heat exchanger;

a first opening formed in the top shell for exhausting the stream of air passing across the heat exchanger;

a flexible and extendable first conduit coupled to the first opening in the air-cooling lid;

a power source, the power source configured to power each of the first fan and the pump;

a second fan positioned for advancing the stream of air through the heat exchanger;

a second opening formed in the top shell for exhausting the stream of air passing across the heat exchanger;

a second conduit coupled to the second opening in the air-cooling lid; and a wall extending between the first fan and the second fan to separate a first portion of the stream of air and a second portion of the stream of air; wherein:

the first portion of the stream of air is expelled through the first conduit and the second portion of the stream of air is expelled through the second conduit, and at least the heat exchanger and the first fan are positioned between the top shell and the bottom shell that form the air-cooling lid.

* * * * *